US006277180B1

(12) United States Patent
Condra et al.

(10) Patent No.: US 6,277,180 B1
(45) Date of Patent: Aug. 21, 2001

(54) METHOD OF REPLACING EVAPORATION LOSSES FROM COLLOIDAL CATALYST BATHS

(75) Inventors: Richard Carroll Condra, Highland Village; Paul Christopher Healey, Garland, both of TX (US)

(73) Assignee: Oliver Sales Company

( * ) Notice: Subject to any disclaimer, the term of this patent is extended or adjusted under 35 U.S.C. 154(b) by 0 days.

(21) Appl. No.: 09/350,936

(22) Filed: Jul. 12, 1999

(51) Int. Cl.[7] ..... C23C 18/30; C23C 18/31

(52) U.S. Cl. ..... 106/1.05; 106/1.11; 106/1.18; 106/1.21; 106/1.22; 106/1.24; 106/1.25; 106/1.28

(58) Field of Search ..... 106/1.11, 1.18, 106/1.21, 1.22, 1.24, 1.25, 1.28

(56) References Cited

U.S. PATENT DOCUMENTS 3,649,350 * 3/1972 Agens ..... 106/1.27
3,977,884 * 8/1976 Gulla et al. ..... 106/1.26
4,152,164 * 5/1979 Gulla et al. ..... 106/1.27
4,229,492 * 10/1980 Leister et al. ..... 427/345
4,357,372 * 11/1982 Leister et al. ..... 427/345
4,554,182 * 11/1985 Bupp et al. ..... 427/304
4,933,010 * 6/1990 Okabayashi ..... 106/1.11
5,071,517 * 12/1991 Okabayashi ..... 205/158

* cited by examiner

*Primary Examiner*—Helene Klemanski
(74) *Attorney, Agent, or Firm*—Larry B. Dwight

(57) ABSTRACT

A method to make volumetric additions of dilute aqueous acid solutions to a colloidal catalyst bath that will retard the salt crystallization. The process includes the steps of measuring the volumetric loss of water by physical measurements and adding dilute aqueous acid solution to the bath in the amount of the loss or by measuring the density or specific gravity of the solution and adding dilute aqueous acid solutions to maintain the specific gravity in the desired range.

14 Claims, No Drawings

METHOD OF REPLACING EVAPORATION LOSSES FROM COLLOIDAL CATALYST BATHS

BACKGROUND OF INVENTION

This invention is a method to improve certain direct plating processes by making volumetric additions. In the manufacture of printed circuit boards, holes are often drilled or punched through dielectric sheets clad on both sides with copper foil. The walls of the holes through the dielectric are then rendered electrically conductive by application of a thin conductive film. A much thicker deposit of electroplated metal, usually copper, is then applied to the walls of the through holes. The electroplated deposits form a physically strong, shock resistant electrical connection between the copper on one surface of the dielectric and the copper on the opposite surface of the dielectric. Numerous types of films have been used to render the walls of the through holes conductive including: electroless copper deposits, electroless nickel deposits, carbon black suspensions, graphite suspensions, and precious metal colloidal suspensions. This invention deals with colloidal suspensions of precious metals, especially palladium, and most especially with palladium/tin colloids, used to render the hole walls conductive in preparation for subsequent electroplating. This invention deals particularly with palladium/tin colloids disclosed in U.S. Pat. No. 4,933,000 issued to Okabayashi and the method of using such colloids for making nonconductive surfaces conductive as disclosed in U.S. Pat. No. 5,071,517 issued to Okabayashi.

Colloidal suspensions used to make nonconductive surfaces conductive are made of a tin stabilized precious metal colloid dispersed in an acidic, aqueous solution of a salt, usually sodium chloride. The precious metal colloid is called the catalyst. The acidic, aqueous salt solution is called the carrier. When mixed together the precious metal colloid and the carrier are called the catalyst bath. The salt concentration in the carrier solution is often near the maximum amount that is soluble in aqueous solutions at normal operating temperatures. The most commonly used catalyst in printed wiring board manufacture is tin stabilized palladium colloid. The catalyst disclosed in the above referenced patents also contains an organic stabilizing ingredient, usually an aldehyde, such as vanillin, dissolved in the aqueous salt solution.

One of the problems with this process is salt crystallization. In the normal operation of catalyst baths, the temperature of the bath is maintained at approximately 105° F. Water evaporates from the bath. As water evaporates, salt crystals form in the bath. The crystals accumulate on the walls and bottom of the tank in hard agglomerations. The agglomerations coat heat transfer surfaces reducing heating efficiency.

Under production conditions, volume losses from evaporation arc often replaced with carrier solution. The carrier solution contains a substantial quantity of salt. As more water evaporates, the salt from the additions of carrier also crystallize from the bath.

In dip applications, when the salt deposits collect on the tank walls, they reduce the clearance between baskets used to hold parts and the side walls of the tanks. This makes it difficult to insert baskets into the tank. When salt crystals accumulate on the bottom of the tank, they can keep the baskets from being fully immersed in the bath, thus preventing processing of some areas of the parts in the baskets.

In applications when the bath is pumped, sprayed, or flooded onto parts, the salt deposits often break loose from the surfaces where they have accumulated. Particles of crystallized salt clog screens, pumps, flood heads, and nozzles of the equipment. The salt crystals can also clog the through holes in the work pieces, resulting in incomplete coverage of the hole walls by the colloidal catalyst bath. This can result in defects in the finished workpieces, which make them unsuitable for use. This in turn results in rejected parts and excessive cost. Removing clogging salt crystals from screens, nozzles, flood heads and other parts of the pumping system often requires that the manufacturing process be halted while the particles are removed. This can result in undesirable downtime for the process of building the parts.

In the past, when it became necessary to remove the salt deposits from process tanks, the crystals were mechanically broken loose from the tank and/or heater surfaces and scooped out of the bath. Alternatively, the bath would be allowed to cool to crystallize as much of the excess salt as possible. The cooled bath would be pumped out of the process tank into a collection vessel. Water would be placed in the emptied process tank and stirred to dissolve the excess salt deposits. Often hot water would be used or the water in the tank would be heated to hasten dissolution of the salt. Both of these cleaning procedures required interruption of production, were labor intensive, and were dirty operations.

Up to the time of this invention, it was believed that additions of water adequate to avoid crystallization of salt in the bath, would cause deterioration of the tin/palladium colloid of the catalyst, presumably due to hydrolysis. Producers of colloidal catalyst warn against adding water to the catalyst bath. This is specifically stated in Operating Instructions for IN 504 Activator written by Solution Technology Systems, an assignee of Okabayashi. In fact, laboratory tests have shown that additions of water to catalyst baths can cause deterioration of the colloid and resulting poor performance. When large volumes of water are added rapidly to catalyst baths, the normally uniform, opaque, black colloidal suspension of tin stabilized precious metal becomes lighter in color and grainy and non-uniform in appearance. In severe cases, such water contaminated catalyst baths may separate on standing. The particles of precious metal in the destabilized colloid no longer remain in suspension. Instead, they fall to the bottom of the container. Such separated baths are ineffective. Very small additions of water added very slowly with vigorous mixing have less adverse effect on the catalyst. But the small size and slow rate of additions as well as the excessive mixing required to avoid damage to the stability and performance of the catalyst make adding water directly to the catalyst bath unsatisfactory under production conditions.

The performance of the catalyst bath can be measured indirectly by testing the side-to-side resistance of catalyst activated copper clad dielectric workpieces with through holes. This is done using an ohmmeter and placing one contact on each planar side of the workpiece. Before treatment of the workpiece, the meter shows an open that is over one mega-ohm of resistance. After treating the workpiece with the colloidal catalyst bath, the resistance will be reduced. Prior art teaching the direct plating processes, using such tin/palladium catalysts as discussed herein, also teaches that on similar workpieces, the lower the side-to-side resistance of the catalyst activated workpieces, the more effective is the activation of the walls of the through holes. Although measuring the side to side resistance provides numerical values for effectiveness of activation, it is an indirect measurement.

Another method to test performance of a catalyst bath is to electroplate the copper clad workpiece after processing through the entire activation process. The walls of the plated through holes are then visually inspected under magnification, usually with a 10 to 15 power magnifier. The hole walls will be fully covered by the electroplated deposit if the catalyst is performing properly. The relative smoothness of the plated deposit in the hole is used to estimate the quality of the activation by the catalyst. The smoother and more uniform the electroplated deposit, the better the activation is considered to be. This method provides only a qualitative evaluation of the performance of the catalyst, but it directly determines the actually performance of the catalyst.

Catalyst baths that receive additions of water so that the bath appearance becomes non-uniform and light colored, yield side to side resistance readings much greater than similar baths not receiving the detrimental additions of water. The additions of water reduce the effectiveness of the bath. Additionally, the hole walls activated with such water contaminated baths often exhibit incomplete coverage after electroplating. For that reason it is customary to take care to minimize introduction of water into the catalyst bath. Before water wetted parts are placed in catalyst baths, they are typically first dipped into or otherwise contacted with a solution containing all the components of the catalyst bath except the precious metal colloid. This solution is known as a predip bath. The function of the predip bath is to displace and/or absorb water from the parts so as to reduce the amount of water introduced into the catalyst bath.

SUMMARY OF THE INVENTION

The method disclosed herein is to make volumetric additions of dilute aqueous acid solutions to the catalyst bath that will retard the salt crystallization. The method comprises the steps of measuring the volumetric loss of water by physical measurements and adding dilute aqueous acid solution to the bath in the amount of the loss or by measuring the density or specific gravity of the solution and adding dilute aqueous acid solutions to maintain the specific gravity in the desired range.

The primary object of this invention is provide a method to prevent or retard formation of crystals of salt in tin stabilized precious metal catalyst baths used in direct plating processing.

It is a further object of this invention to provide a method to replace evaporation losses of water from catalyst baths without adverse effect on the stability of the colloid or performance of the catalyst bath.

It is another object of this invention to provide a stabilized aqueous additive to replace water lost by evaporation. It is yet another object of this invention to provide a method to quantitatively determine the amount of the stabilized aqueous additive required to replace water lost by evaporation.

Other and further objects of the invention will become apparent upon reading the detailed description hereinafter following.

DESCRIPTION OF THE INVENTION

The method disclosed herein is to make volumetric additions of dilute aqueous acid solutions to the catalyst bath that retard or completely prevent crystallization of salt without causing any significant deterioration of the ti/palladium colloid and without resulting poor performance. The method comprises the steps of measuring the volumetric loss of water by physical measurements and adding dilute aqueous acid solution to the bath in the amount of the loss; or measuring the density or specific gravity of the solution and adding a dilute aqueous acid solution to restore the bath to a desired specific gravity range at which salt does not crystallize from the bath. For example, water evaporates from a catalyst bath with an original volume of 1000 ml until the volume of the catalyst bath is 900 ml. An addition of 100 ml of dilute aqueous acid solution restores the evaporation losses. Alternatively, water evaporates from a catalyst bath with an original specific gravity of 1.18 so that the specific gravity rises to 1.20. An addition of dilute aqueous acid solution is made to the catalyst bath to restore the specific gravity to 1.18.

The addition of relatively small quantities of dilute aqueous acid solution retards the formation of crystals in catalyst baths as water evaporates. Working baths in which crystals have already formed can be returned to their original, uniform, crystal free state by larger additions of dilute aqueous acid solution.

It is possible to add relatively large volumes of dilute aqueous acid solutions without degrading the stability or performance of catalyst baths. Furthermore, the rate of addition of the dilute aqueous acid solutions and the rate of mixing with the catalyst bath is not critical. Relatively large additions of dilute aqueous acid solution added quickly to catalyst baths with only moderate mixing rates have little or no adverse effect on the stability of the bath as determined by visual appearance. No graininess, no change in color, and no separation of the catalyst bath was observed after additions of the dilute aqueous acid solutions.

Furthermore, we have discovered that not only are additions of dilute aqueous acid solutions non-detrimental to the performance of the catalyst bath, such additions are often actually beneficial. The performance of catalyst bath with dilute aqueous acid solution added is often better than the performance before the addition. The side-to-side resistance of activated workpieces is usually improved. Likewise, the uniformity of electroplated deposits onto the activated hole walls is often better after addition of the dilute aqueous acid solution. When the deteriorated performance of catalyst baths to which only water has been added is compared with the enhanced performance of catalyst baths to which dilute aqueous acid solution has been added, this discovery is truly surprising and unexpected. We have determined that this improvement in performance is not simply a function of increased acidity in the catalyst bath. Additions of equivalent acidity in the form of concentrated acid do not yield the same improvement in performance that is observed with additions of dilute aqueous acid solution.

The acids acceptable for use in the dilute aqueous acid solution include hydrochloric acid, sulfuric acid, acetic acid, other non-oxidizing acids which are soluble in concentrated salt solution of the carrier, and mixtures thereof. Hydrochloric acid and sulfuric are the preferred acids. Hydrochloric is the most preferred acid. It is the acid already present in the catalyst bath. Therefore, no spurious ions are introduced into the catalyst bath by addition of dilute aqueous hydrochloric acid solutions.

The required additions of the dilute aqueous acid solution to retard and/or prevent crystallization can be controlled using specific gravity. The specific gravity of the bath is measured and the additions of the dilute aqueous acid solution are calculated. The calculated quantity is added to the catalyst bath as required to bring the specific gravity of the bath to the experimentally determined desirable specific gravity range. Alternatively, an automatic controller may be used to keep the specific gravity within the desired range.

When the specific gravity sensed by the controller exceeds the desired maximum value, the controller automatically adds dilute aqueous acid solution to bring the catalyst bath to the desired specific gravity. Commercially available controllers are suitable for this application. One such controller is the Optrol Acid Etchant Control/Monitor, Model 111 available from Optrol Inc., Raleigh, N.C.

In addition, the same or similar organic stabilizer used in the catalyst, usually vanillin, may be dissolved in the dilute aqueous acid solution. Including the organic stabilizer in the dilute aqueous acid solution allows replacement of stabilizer lost from the bath by drag out and by sorption onto the surfaces of the parts, tank walls, and racks. When powdered vanillin, the preferred stabilizer in the catalyst, is added directly to the bath it is difficult to dissolve. Some of the vanillin is often left undissolved and settles to the bottom of the tank where it is ineffective. Vanillin is usually more soluble in the dilute aqueous acid solution than in the highly concentrated salt solution of the carrier solution. By incorporating vanillin into the dilute aqueous acid solution, it is more easily dissolved and can be added to the bath more efficiently.

Elimination of the salt crystals from activator baths allows easier and more efficient filtration of the baths. Previously, the salt crystals quickly clogged filters. Only coarse filter screens could be used. Prevention of crystallization, as disclosed in this invention, allows use of finer filters for more effective removal of undesirable particulate contaminants from the baths.

The concentration of acid in the dilute aqueous acid solution is from about 0.01% by weight to about 10.00% by weight. The preferred concentration of acid is from about 0.30% by weight to about 4.00% by weight.

The concentration range of organic stabilizer, usually vanillin, which may optionally be added to the dilute aqueous acid solution is from about 0.01% by weight to the maximum solubility in the solution. For vanillin, the maximum solubility at 25° C. is about 1%. At 100° C. the maximum solubility is about 5%. The preferred concentration of organic stabilizer in the dilute aqueous acid solution is about 0.05% by weight to about 0.50% by weight.

The specific gravity of freshly prepared catalyst baths varies somewhat depending on the amount of catalyst added to the carrier. Typically, the specific gravity of a freshly prepared catalyst bath is about 1.18 to about 1.19 at 25° C. Substantial crystallization of salt occurs when enough water has evaporated from the bath to raise the specific gravity to about 1.20 to 1.24. For optimum performance of the catalyst bath without crystallization of salt, the specific gravity of the bath is controlled at about 1.14 to 1.19 by additions of dilute aqueous acid solution. The following equation may be used to calculate additions of dilute aqueous acid solution.

$$V_{aa}=V_b\times[(S.G._b-S.G._d)\div(S.G._d-S.G._a)]$$

Where:

$V_{aa}$=Volume of dilute aqueous acid solution to be added $V_b$=Volume of catalyst bath $S.G._b$=Measured specific gravity of the catalyst bath $S.G._d$=Desired specific gravity of the catalyst bath $S.G._{aa}$=Specific gravity of the dilute aqueous acid solution An example of how to calculate additions of dilute aqueous acid solution is: A 32 gallon catalyst bath with specific gravity of 1.228 is to have its specific gravity lowered to 1.180 using a dilute aqueous acid solution with specific gravity of 1.004.

$$V_{aa}=32\times[(1.228-1.180)\div(1.180-1.004)].$$

$V_{aa}$=8.7 gallons dilute aqueous acid solution to add to 32 gallons catalyst bath.

The efficacy of the method of this invention is clearly illustrated by the following example: A working catalyst bath was allowed to evaporate until the specific gravity rose to 1.230. Salt crystals formed in the bath. This catalyst bath was used to activate the hole walls of epoxy resin coated fiberglass laminate test panels. The test panels were 2"×3"×0.062" thick. They were clad on each side with nominal 0.00136" thick copper foil. Two hundred holes ranging from approximately 0.020" to approximately 0.090" in diameter were drilled through both layers of the copper cladding and the epoxy resin coated fiberglass of each test panel. The steps in the activation process were: Clean and condition the test panel with a solution of HN-500™ Cleaner/Conditioner at 140° F. Dip rinse in tap water at ambient temperature. Immerse in undiluted HN-503™ Predip at ambient temperature. Activate in HN-504™ Catalyst bath at 105° F. Dip rinse in tap water at ambient temperature. Accelerate activation in HN-505™ Accelerator bath at 140° F. Dip rinse in tap water at ambient temperature. Immerse in 10% by volume solution of 96% sulfuric acid. Dip rinse in tap water at ambient temperature. Dip rinse in deionized water at ambient temperature. Dry with warm air blower. The side-to-side resistance of the activated test panels was measured using an ohmmeter. The resistance of the test panels ranged from 520 to 820 Ω. HN-500™, HN-503™, HN-504™, and HN-505™ are products commercially available from Oliver Sales Company, Dallas, Tex.

A 210 ml portion of the catalyst bath referenced heretofore was mixed with 40 ml of a dilute aqueous acid solution. The dilute aqueous acid solution was prepared by mixing 1% by volume of 36% hydrochloric acid with water. This mixture was equal to 0.42% by weight hydrochloric acid. When the dilute aqueous acid solution was stirred into the portion of the catalyst bath, the crystallized salt redissolved. There was no visual indication of instability of the diluted catalyst bath due to the addition of the dilute aqueous solution. The specific gravity of the diluted portion of the catalyst bath was determined to be 1.192. Test panels as described above were activated using the same baths and the same process described above except the original catalyst bath was replaced with the 210 ml portion of catalyst bath mixed with 40 ml dilute aqueous acid solution. The side-to-side resistances ranged from 20 to 21 Ω. This dramatic reduction in the side-to-side resistance indicates that the diluted catalyst bath activated the non-conductive surfaces of the hole walls much more effectively than the original catalyst bath.

A 175 ml portion of the original catalyst bath referenced heretofore was mixed with 75 mls of the dilute aqueous acid solution described above. When the dilute aqueous acid solution was mixed with the catalyst bath, the crystallized salt dissolved. There was no visual indication of instability of the diluted catalyst bath. The specific gravity of the diluted catalyst bath was determined to be 1.160. Test panels as described above were activated using the same baths and the same process described above except the original catalyst bath was replaced with the 175 ml portion of the catalyst bath diluted with 75 mils dilute aqueous acid solution. The side-to-side resistances of these test panels ranged from 4.9 to 7.8 Ω. The dramatic reduction in side-to-side resistance indicates that the second diluted catalyst bath activated the non-conductive surfaces of the hole walls much more effectively than the original catalyst bath and significantly better than the first diluted catalyst bath.

All three sets of test panels were electroplated with acid copper plating bath at approximately 30 amps per square foot current density for 6 minutes. The hole walls of the test panels were inspected visually using 10 power magnification. All holes plated completely. When compared with the test panels processed with the original catalyst bath, the uniformity, reflectivity, and leveling of drilling gouges in the hole walls were visually superior on the test panels processed with the diluted catalyst baths.

Other embodiments are contemplated by the above description.

We claim:

1. A method of restoring the volume of liquid lost by evaporation from a tin/palladium colloidal catalyst bath, having a salt solution for a carrier, which method does not add to the salt concentration thereof, comprising the steps of: quantifying the volume of the liquid lost; and replacing the liquid lost with a dilute aqueous acid solution selected from the group consisting of hydrochloric acid, sulfuric acid, or acetic acid.

2. The method as claimed in claim 1 wherein the dilute aqueous acid solution contains between 0.30% and 4.0% by weight acid.

3. The method as claimed in claim 1 wherein the dilute aqueous acid solution includes a stabilizing agent.

4. The method as claimed in claim 1 wherein the dilute aqueous acid solution includes vanillin.

5. The method as claimed in claim 1 wherein the dilute aqueous acid solution includes vanillin 0.05% to 0.5% by weight.

6. The method as claimed in claim 1 wherein the step of qualifying the volume of the liquid lost is: measuring the specific gravity of the solution; and the step of replacing the liquid lost includes decreasing, the specific gravity.

7. The method as claimed in claim 1 wherein the step of quantifying the volume of the liquid lost is: measuring, the volume of the liquid lost.

8. A method of restoring the volume of liquid lost by evaporation from a tin/palladium colloidal catalyst bath, having, a colloid suspended in a salt carrier solution, which method does not add to the salt concentration thereof, comprising the steps of: quantifying the volume of the liquid lost from the catalyst bath; and replacing the lost liquid with a dilute aqueous acid solution of hydrochloric acid containing between 0.30% and 4.0% by weight acid.

9. The method as claimed in claim 8 wherein the dilute aqueous acid solution includes a stabilizing agent.

10. The method as claimed in claim 8 wherein the dilute aqueous acid solution includes vanillin.

11. The method called for as claimed in claim 8 wherein the step of quantifying the volume of the liquid lost is: measuring the specific gravity of the solution; and the step of replacing the liquid lost includes decreasing the specific gravity.

12. The method as claimed in claim 8 wherein the step of quantifying the volume of the liquid lost is: measuring the volume of the liquid lost.

13. The method as claimed in claim 8 wherein the dilute aqueous acid solution includes vanillin 0.05% to 0.5% by weight.

14. The method called for in claim 1 wherein the dilute aqueous acid solution includes vanillin 0.05% to 0.5% by weight.

* * * * *